US005544861A

United States Patent [19]

Wisner et al.

[11] Patent Number: 5,544,861

[45] Date of Patent: Aug. 13, 1996

[54] ADJUSTABLE RISER-RAMP ASSEMBLY

[75] Inventors: Craig A. Wisner, Wauwatosa; James C. Graham, Waukesha; Thomas F. Mandery, Pewaukee, all of Wis.

[73] Assignee: Hein-Werner Corporation, Waukesha, Wis.

[21] Appl. No.: 237,458

[22] Filed: May 3, 1994

[51] Int. Cl.[6] ..... B21D 1/12

[52] U.S. Cl. ..... 254/88; 187/221; 72/705

[58] Field of Search ..... 72/705; 254/88; 187/203, 204, 221

[56] References Cited

U.S. PATENT DOCUMENTS

| | | | |
|---|---|---|---|
| 2,076,069 | 4/1937 | Davis | 254/88 |
| 3,856,264 | 12/1974 | Thumma | 254/88 |
| 3,994,474 | 11/1976 | Finkbeiner | 254/88 |
| 4,313,335 | 2/1982 | Eck | 72/457 |
| 4,341,371 | 7/1982 | Rotella | 254/88 |
| 4,921,074 | 5/1990 | Ochs | 187/204 |
| 5,054,307 | 10/1991 | Wisner | 72/457 |
| 5,269,501 | 12/1993 | Liegel | 269/17 |
| 5,357,777 | 10/1994 | Castellano | 72/705 |

OTHER PUBLICATIONS

Hein–Werner Corporation, Introducing The Ultimate Rack, inside two pages, 1990.

*Primary Examiner*—Lowell A. Larson
*Attorney, Agent, or Firm*—James A. Wilke

[57] ABSTRACT

An apparatus and method for lifting a vehicle above a work surface of a vehicle repair system and maintaining the wheels of such a vehicle at a height near the same height as the vehicle is raised. The apparatus is an adjustable riser-ramp assembly which includes a platform having a pair of adjustable, self-locking leg sets, at least one ramp removably attached to the platform and a mounting slide engaging the platform and the work surface. The apparatus may be used in multiple combinations of platform and ramps to accommodate the type of vehicle and type of repair system being worked on by an operator.

9 Claims, 8 Drawing Sheets

ADJUSTABLE RISER-RAMP ASSEMBLY

FIELD OF INVENTION

The present invention relates to an apparatus supporting a vehicle over a work surface and more particularly to an adjustable riser-ramp assembly compatible with various frame straightening racks, benches and floor systems used in vehicle collision repair.

BACKGROUND OF THE INVENTION

In the vehicle collision repair business it is necessary to know measurements on a vehicle under varying conditions. Various systems to obtain and verify those measurements have been developed, including several produced by this Applicant's Assignee. In most cases the measurements are taken on an undamaged vehicle and then again on a damaged vehicle. Those measurements are compared to determine the extent of damage and to guide the repair process. To obtain such measurements a vehicle is placed on a frame straightening rack, bench or floor system and measured using one or more measurement systems. Since some of the measurements are taken on the underside of a vehicle, accessibility to the vehicle's underside is necessary. In addition, the vehicle must be secured to the collision repair apparatus, such as this Assignee's U.S. Pat. No. 4,313,335 entitled Vehicle Work Rack Structure, before repairs can be made. In order to secure a vehicle to the repair apparatus various devices have been developed such as this Assignee's Universal Vehicle Stand, U.S. Pat. No. 5,054,307. To use such securing device, the vehicle must be raised above the repair apparatus work surface and then the vehicle is attached to the securing device and often to at least three such securing devices. Various means are used to lift the vehicle so that the securing device can be attached to the vehicle, such as the vehicle and vehicle part transportation system owned by this Applicant's Assignee, U.S. Pat. No. 5,269,507.

Vehicles are typically measured under two different conditions; with the wheel suspension loaded, i.e. with weight on the suspension or with the wheel suspension unloaded. Several methods can be used to obtain the necessary vehicle measurements both before and after repair work is performed. The degree of flexing of the vehicle body, the type of body damage involved and the particular measuring system being utilized by the operator all must be considered in determining whether the measurements will be taken with the wheel suspension loaded or unloaded.

One method of loading the wheel suspension is to jack up each wheel of the vehicle to be measured and placing a mechanical blocking apparatus under each wheel of the vehicle. Various lifting devices can be used such as a bottle jack, a service jack, an air bag jack, lift bars attached to a work tower associated with a vehicle repair rack or some such other typical device. Some disadvantages of this method include maintaining a sufficient amount of wheel blocking (such as wood blocks) and the time involved in lifting and lowering each wheel of the vehicle during the set-up and take-down of each configuration, including the fact that wheels are lifted one or two at a time.

A second method for supporting or loading the wheel suspension of a vehicle is to remove the tire and wheel assembly and attaching a wheel overhang compensator stand to the wheel lug nuts. Again, the operation of lifting and lowering the individual wheels of a vehicle must be performed as in the previously described method, resulting in unproductive time expended by the operator.

A third method is to use pivot riser-ramps such as shown in the photograph annexed to this application and incorporated herein by this reference. The pivot riser-ramp is placed on the work surface of the vehicle repair apparatus and the vehicle is driven onto such pivot riser-ramp thereby elevating the vehicle so that the securing device can be positioned and attached to the vehicle. A problem with the above described pivot riser-ramps is that they lift a vehicle to a fixed height and usually are built for use with a specific repair apparatus. Additionally, the operator of the vehicle being driven on and off the ramps does not know the vehicle location with respect to the pivot riser-ramps which could result in the vehicle being damaged as it falls off of the pivot riser-ramp. In addition, the fact that the pivot riser-ramp moves through an arc as the vehicle is moved on or off the ramp can cause the operator unnecessary anxiety, especially if each pivot riser-ramp moves at a different time during the operation.

Lack of compatibility of existing pivot riser-ramp devices with more than one vehicle repair system is another problem encountered by vehicle repair shop operators.

SUMMARY OF THE INVENTION

The present invention advantageously provides an apparatus and method for lifting a vehicle above a work surface of a vehicle repair system and maintaining the wheels of such a vehicle at a "ride height" (wheels raised near to the same height as the vehicle is raised) during a vehicle measurement and repair procedure. The assembly provides variable height adjustments to a platform used to support the wheels of a vehicle, a ramp removably connected to the platform at the desired height adjustment and a device for attaching the assembly to the work surface of most any type of vehicle repair system. The present invention also facilitates the operator's ability to drive-on/drive-off (no back-up operation is necessary) the vehicle repair racks that feature a multiple end tilt ability or are a flat rack.

The present embodiment of the invention is an adjustable riser-ramp assembly which includes a platform having a pair of adjustable, self-locking leg sets, a ramp removably attached to the platform and an adjustable retaining device engaging the platform and having a means for connecting and retaining the assembly to the work surface. The present invention also provides an adjustable riser-ramp assembly that is readily removable from the vehicle repair system's work surface, as well as selectively positioned along such work surface, whether such work surface is provided with tie-down slots, key holes, round or rectangular openings or a solid surface.

A principal objective is to provide a height variant between the ramp and the platform to signal to the vehicle operator that the vehicle is adjacent to the riser-ramp assembly and to provide an adjustable wheel stop on the platform to permit the operator to accurately position the vehicle over the work surface.

Another objective of the present invention is to provide a riser-ramp assembly with a pair of leg sets that will self-lock in a high stage position and fold under the platform in a low stage position.

An additional objective of the present invention is to provide methods for using an adjustable riser-ramp assembly for supporting a vehicle above a work surface in combinations of one or more assemblies and lifting any two or four wheels of a vehicle at a time.

An advantage of the present invention is to provide a stable, adjustable, strong riser-ramp assembly compatible with various vehicle repair systems, as chosen by an operator, for lifting a vehicle over a work surface of a rack, bench or floor system.

Another advantage to the present invention is that the riser-ramp assembly maintains the wheel of a vehicle near the same height as the vehicle when the vehicle is secured to the vehicle repair system.

Other principal features and advantages of the invention will become apparent to those skilled in the art upon review of the following drawings, the detailed description and the appended claims.

Figure 1:
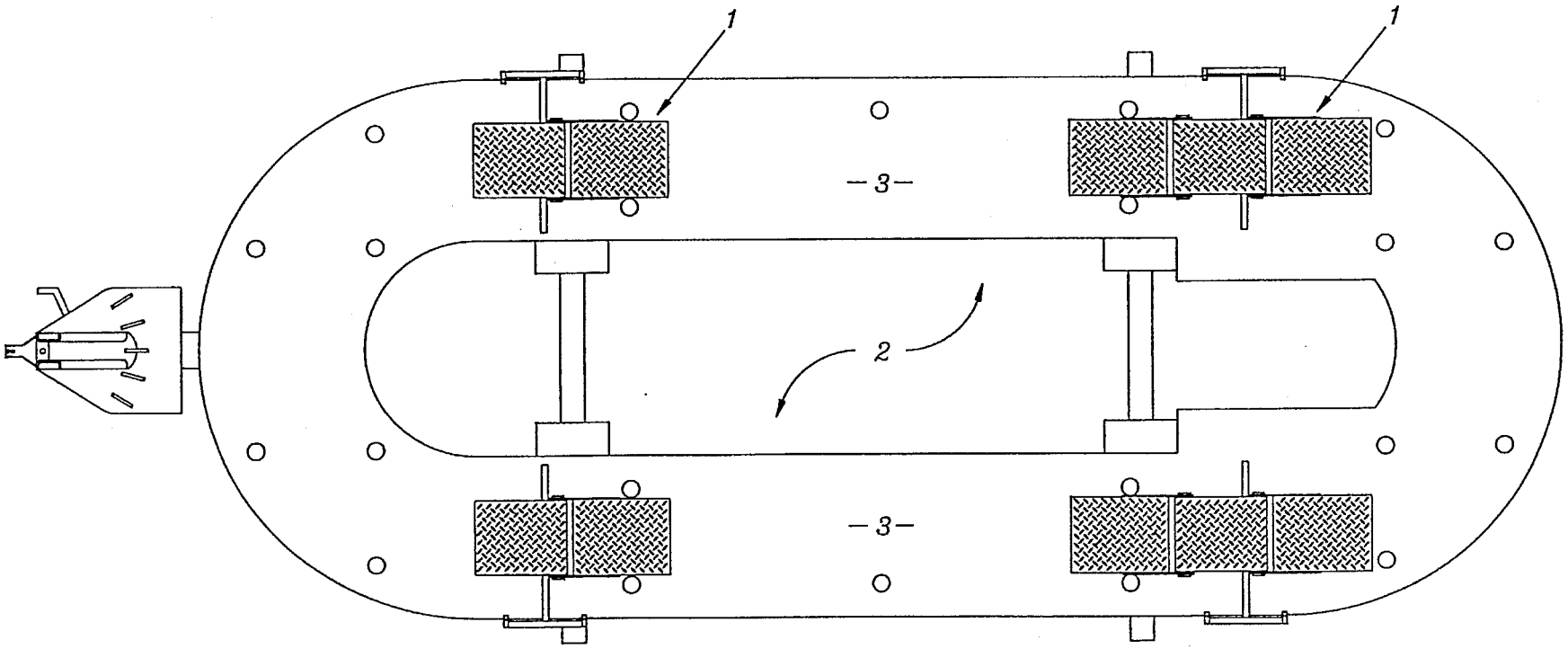
FIG. 1 is a top view of a vehicle repair rack on which are positioned four riser-ramp assemblies of the present invention.
Figure 2A:
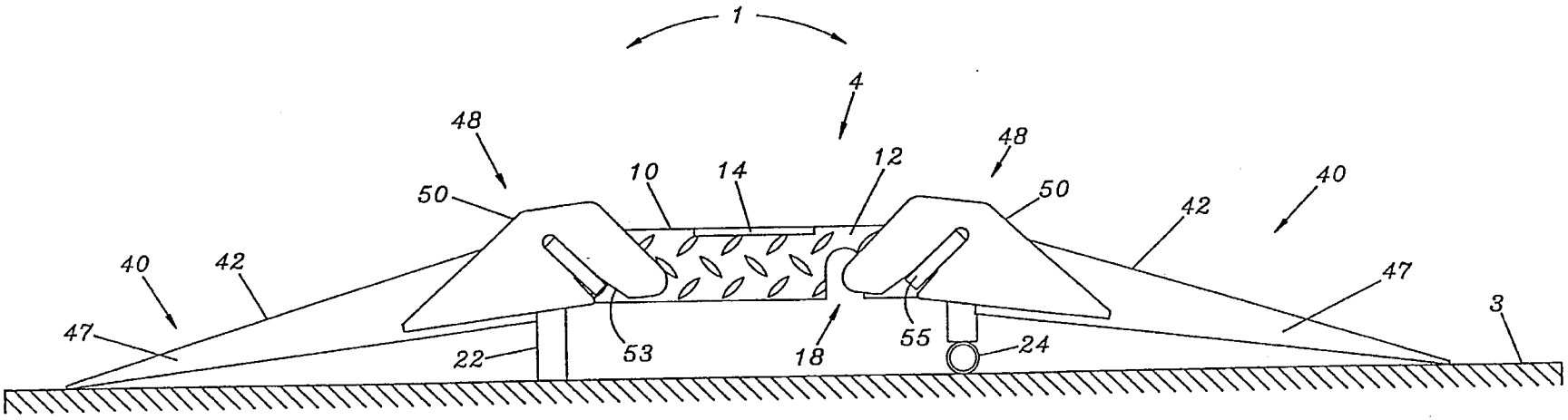
FIG. 2*a* is a side elevation of the riser-ramp assembly in the high stage position.
Figure 2B:
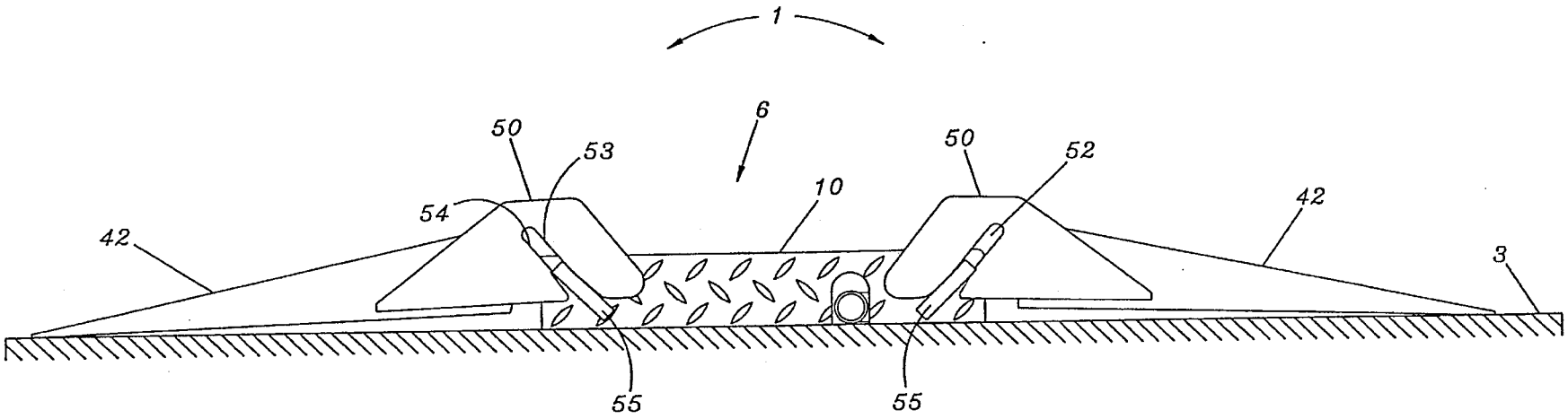
FIG. 2*b* is a side elevation of the riser-ramp assembly in the low stage position.

Although only one embodiment of the invention is explained in detail, it is to be understood that the invention is not limited in its application to the details of construction and the arrangement of components set forth in the following description are illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT

Figure 4C:
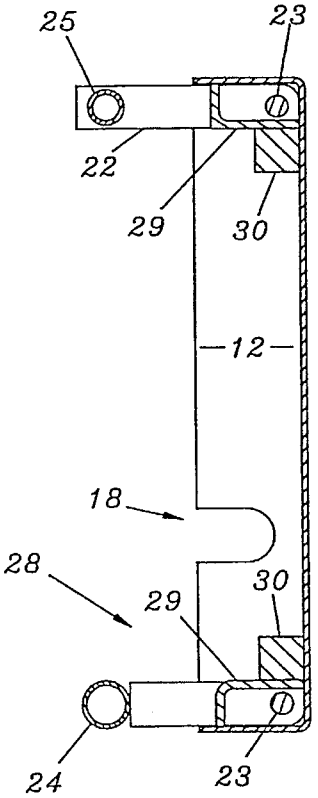
FIG. 4*c* is a sectional view along the sectional line X—X as shown in FIG. 4*b*.
Figure 4A:
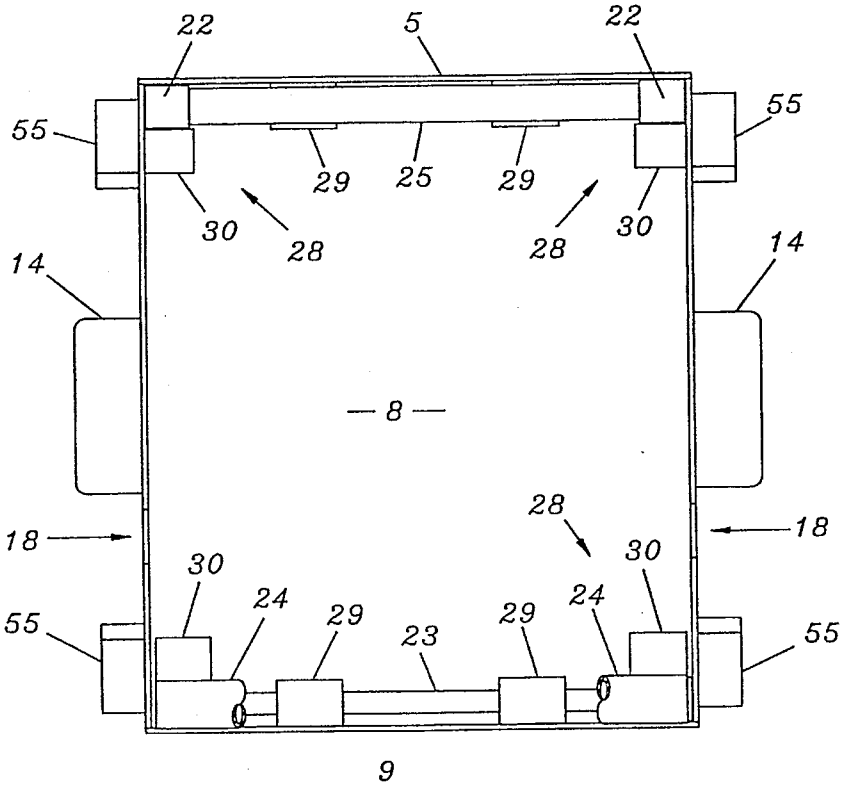
FIG. 4*a* is a plan view of the underside of a platform.
Figure 5:
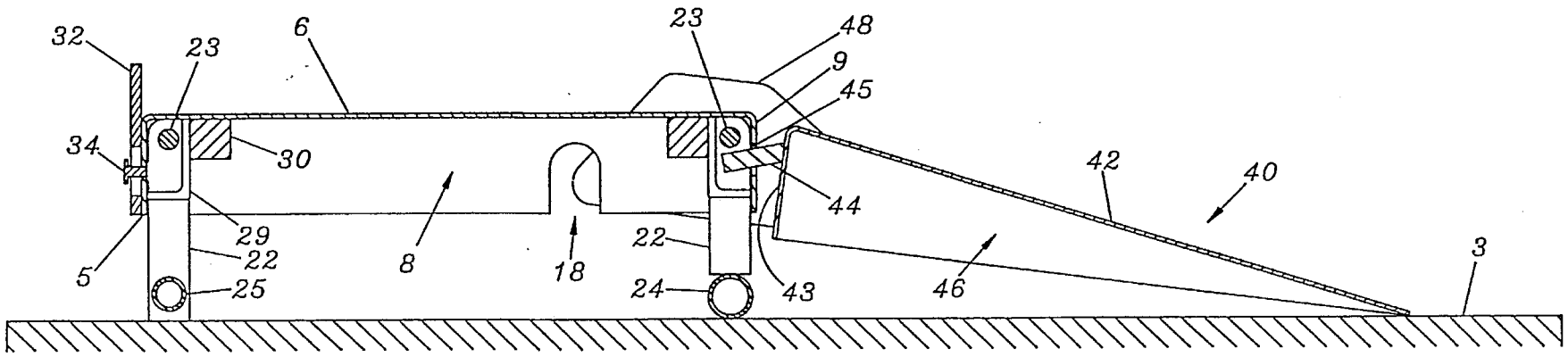
FIG. 5 is a sectional view taken along the middle longitudinal axis of a platform and ramp with the platform having an adjustable wheel stop.
Figure 6:
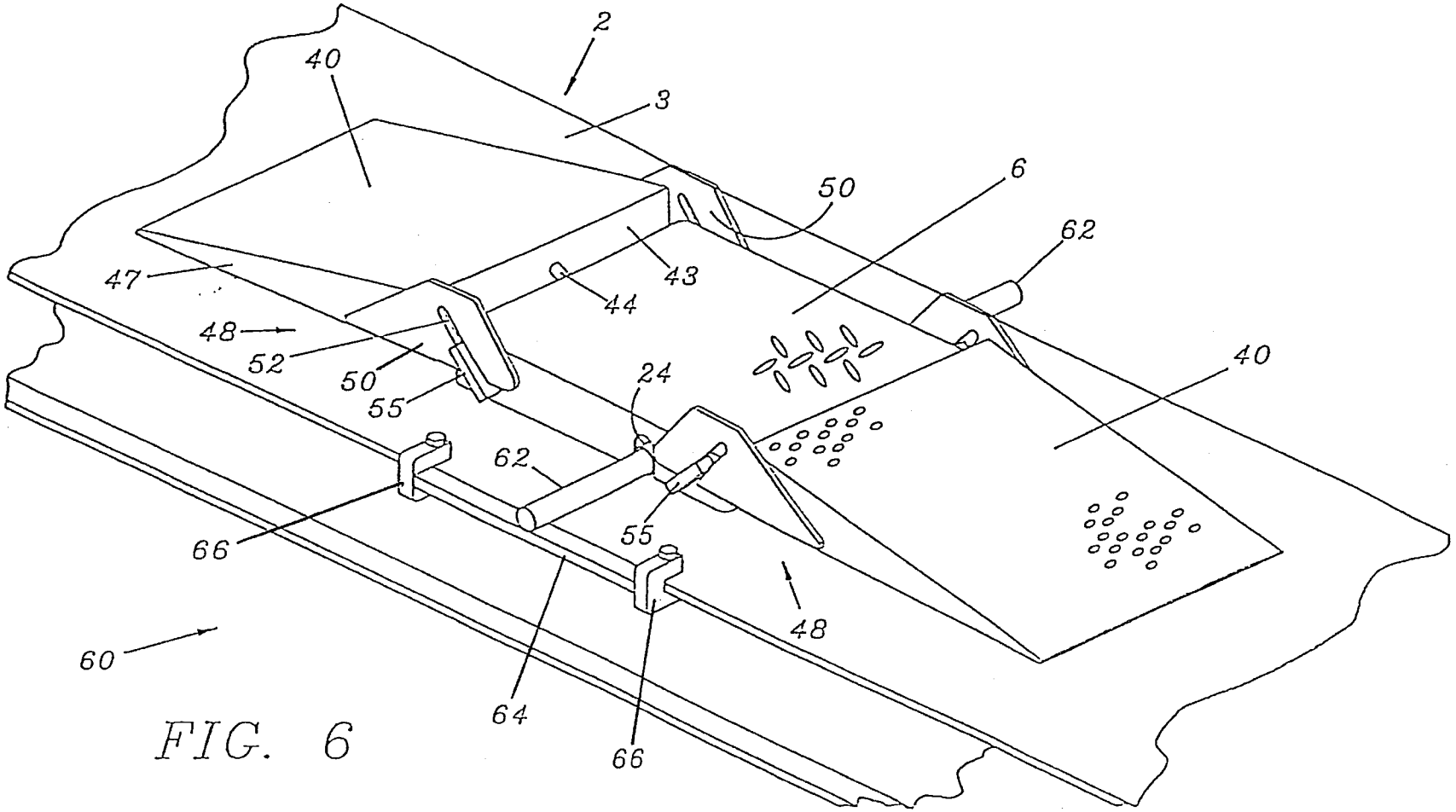
FIG. 6 is a perspective illustration of an adjustable riser-ramp assembly on a rack work surface in the low stage position with an additional ramp for the drive-on/drive-off feature.

As seen FIGS. 2*a*, 2*b*, 3*a*, 3*b* and 6, the adjustable riser-ramp assembly 1 principally includes a platform 4, a ramp 40 and an adjustable retaining device 60. As shown in FIG. 1 multiple adjustable riser-ramps assemblies 1 can be mounted on a work surface 3 of a vehicle repair rack 2. FIGS. 4*a*, 4*c* and 5 illustrate the self-locking leg arrangement. The method for using the adjustable riser-ramp assembly, and the method of using the adjustable riser-ramp assembly in combinations of multiple units which will be described hereinafter.

PLATFORM

Referring to FIGS. 3*a*, 3*b*, 4*a*, 4*b* and 4*c* the platform 4 includes a platform body 6 having a front portion 5, rear portion 9, top plate 10, a pair of sides 12 all defining an underside 8. The platform body 6 is fabricated from formed metal with the preferred embodiment being steel plate stock having non-skid ribbing or a hole pattern or the like. The platform body 6 includes two side plates 12 with each side plate 12 having a guide slot 16 near the front portion 5 and rear portion 9 of the platform body 6 and a low stage notch 18 proximate the rear portion 9 of the each side plate 12 (See FIGS. 3*a* and 3*b*). Each side plate 12 also supports a handle 14 used to lift and lower the platform assembly 1 as will be described hereinafter.

Figure 3A:
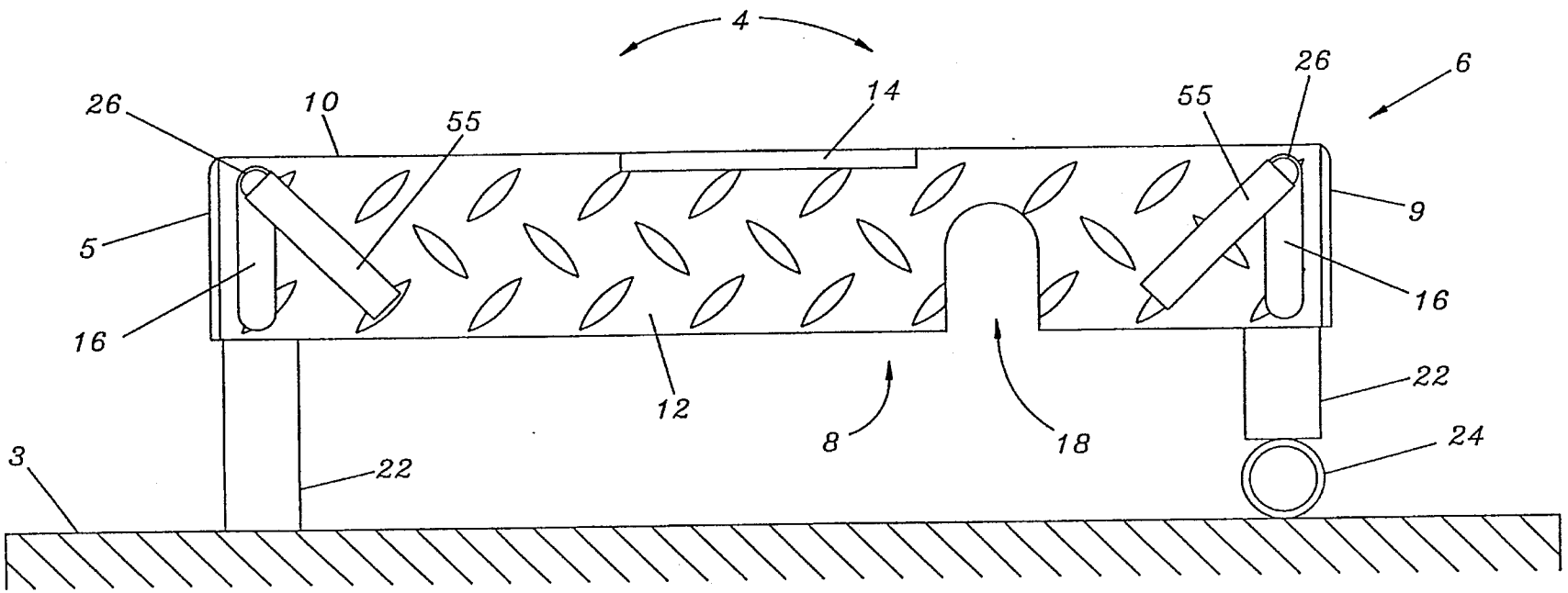
FIG. 3*a* is a side elevation of the platform body having the guide slots with the leg sets in the vertical aspect of the high stage.
Figure 3B:
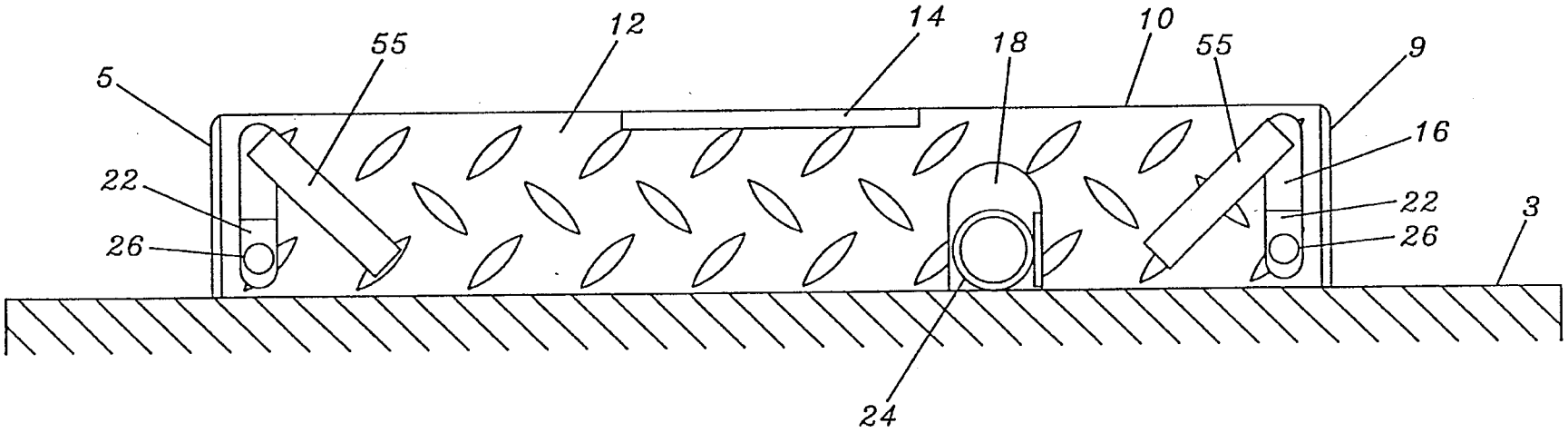
FIG. 3*b* is a side elevation of the platform body having the guide slots with the leg sets in the folded position of the low stage under the platform body.

Another embodiment, as shown in FIGS. 2*a*, 2*b*, 3*a* and 3*b* utilizes an angled key stock 55 attached, as by welding, to the side plate 12 near the platform front 5 and platform rear 9. FIGS. 3*a* and 3*b* show the angled key stock 55 utilized in addition to the guide slot 16. The method of use of this embodiment will be discussed hereinafter.

Referring to FIGS. 4*a*, 4*b*, 4*c* and 5, the platform body 6 is fabricated and forms a platform front 5, a platform top 10, a platform rear 9 and two platform sides 12, all defining a platform underside 8. In each corner of the platform underside 8, a self-locking box 28 is formed by the platform top 10, side 12 and platform front 5 and back 9. In addition, each self-locking box 28 is completed with a leg lock member 30 fixed to the platform sides 12 and platform underside 8 by a convenient means such as welding. The leg lock member 30 is spaced from the front 5 and back 9, respectively, a distance to accommodate a leg 22 of each leg set 20.

Figure 4B:
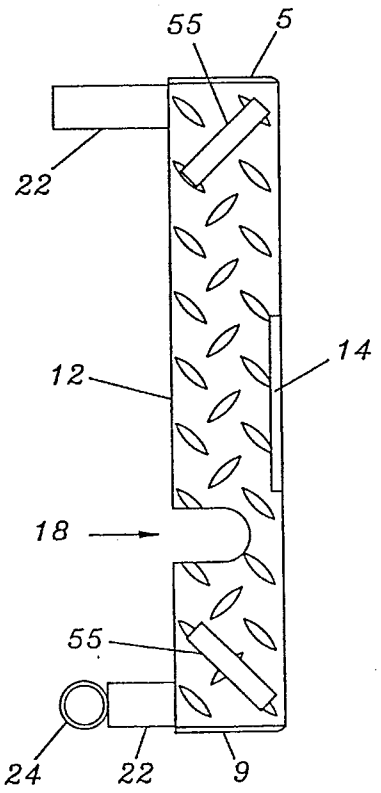
FIG. 4*b* is a side elevation of a platform with the leg sets in an extended position (high stage).

Each leg set 20 includes a pair of legs 22 maintained in a spaced, parallel relationship by an upper leg spacer 23 and a lower leg spacer 25. FIGS. 4*a*, 4*b* and 4*c* illustrates various ways to place the several leg spacers 23, 24 and 25 with the legs and leg spacers being attached to each other by any convenient means such as by welding. The leg set 20 in the rear aspect of the platform 4 also includes a leg traverse tube 24. The inside diameter of the leg traverse tube 24 is sized to accommodate the pivot bar 62 as will be described below. The leg sets 20 pivot in their respective positions about the upper leg spacer 23 in either a high stage (See FIG. 2*a*) or a low stage (See FIG. 2*b*). In the high stage aspect, the leg sets are vertical and perpendicular with respect to the platform body 6 and in the low stage each leg set 20 is folded under the platform body 6 with the leg traverse tube 24 nesting in a low stage notch 18 in each platform side 12.

In operation, the operator lifts the platform body 6 by the handles 14 (the illustrated handles are examples of only one type of handle, the Applicant can also provide hand slots in the side 12 of the platform body 6 to accommodate the operator). As the platform body 6 is raised, gravity operates on the leg sets 20 and each leg set unfolds into a perpendicular aspect with respect to the platform body 6. The legs 22 of each leg set 20 are inserted into the self-locking box 28 as the platform body 6 is lowered to rest on the vertical leg sets. The Applicant has disclosed two embodiments for the pivot of the leg sets as seen in FIGS. 3*a*, 3*b*, 4*a*, 4*b* and 4*c*. FIGS. 3*a* and 3*b* show the guide slot 16, front and back, in the platform sides 12. The leg guide pin 26 engages the guide slot 16 as the leg set 20 is selectively moved from one position (low stage) to another position (high stage) and visa versa. The leg guide pin 26 may be an extension of the upper leg spacer 23 or may be a separate pin. The other embodiment disclosed for pivoting the leg sets 20 is best seen in FIGS. 4*a* and 4*c*. Each leg set 20 is maintained in position under the platform body 6 by a pair of spaced apart leg retainer guides 29 fixed to the underside 8 of the platform 4 such as by welding. The leg retainer guides 29 functions as a hinge for the leg set to pivot about the upper leg spacer 23, however the leg retainer guides 29 are shaped to allow the leg set 20 to move a distance sufficient to clear the self-locking box 28 when the operator lifts the platform and folds the legs under the platform 4 from the high stage to the low stage.

The platform 4 is also provided with a ramp lock pin hole 45 in the platform rear 9 and platform front 5. In addition, two of the adjustable riser-ramp assemblies 1 are provided with an adjustable wheel stop 34. The wheel stop is attached to the platform front 5 by a wheel stop connector 34 of convenient construction.

RAMPS

Each adjustable riser-ramp assembly 1 of the present invention has at least one ramp 40 and when used in a set for four assemblies, as shown in FIG. 1, at least two of the assemblies 1 have two ramps each. Usually the back set of assemblies (back of the vehicle repair rack 2) are the assemblies that have the additional ramps. Attention is directed to FIGS. 2*a*, 2*b*, 5 and 6.

Each ramp 40 is formed from metal with the preferred embodiment being steel and preferably having a non-skid surface. The preferred embodiment has dimpled perforations on the ramp surface that inhibits tire slipping as a vehicle is moved onto or off of the adjustable riser-ramp assemblies. The ramp, as formed, has a ramp top 42, a ramp front 43 and a pair of ramp sidewalls 47 all defining a ramp underside 46. Attached to the ramp front 43 is a ramp lock pin 44 that engages, by insertion, the ramp lock pin hole 45 in the platform body 6. The lock pin 44 prevents the ramp from sliding, on the work surface 3, away from the platform body 6 during the loading and unloading of a vehicle and also locks the leg set 20 in the vertical position when the platform 4 is in the high stage.

Each ramp 40 also is provided with a multi-level slide lock 48 fixed to each ramp sidewall 47 near the ramp front 43. The multi-level slide lock 48 includes a slide plate 50 having an angled lock slot 52 defined by a front surface 53 and a back surface 54. Each platform body 6 has a pair of angled key stock members 55 fixed to the platform sides 12, near the front 5 and rear 9 of the platform body 6. The angled key stock member 55 is positioned at the same angle as corresponds to the angle of the angled lock slot 52 in the slide plate 50. The ramp 40 is attached to the platform body 6 by aligning the ramp lock pin 44 with a ramp lock pin hole 45 and aligning the angled lock slot 52 with each angled key stock member 55 and engaging all such elements. When the platform 4 is in both its high stage and low stage there is a height difference between the platform top 10 and the ramp top 42. The height difference provides an indicator to the operator of a vehicle moving onto or off of the adjustable riser-ramp assembly 1 as to the approximate position of the vehicle's wheel with respect to the ramp 40 and platform 4. In other words the operator will feel a bump as the vehicle tire moves from one height to the other height between the platform 4 and the ramp 40. The wheel stop 32 on the front assembly also provides an indicator to the operator as to the approximate location of the vehicle with respect to the adjustable riser-ramp assembly 1. The wheel stop 32 is adjustable in height to facilitate the drive-on/drive-off operation and to accommodate any additional attachment used in the measurement or repair process. During the movement of the vehicle onto and off of the platform body 6, the ramp is moved toward or away from the platform body by the vehicle's tire, which action engages the front surface 53 and the back surface 54 of the angled lock slot 52 with the angled key stock member 55 in both the high stage and low stage of the assembly 1. The ramp lock pin also functions as a leg set 20 lock when the platform body 6 is in the high stage as the ramp lock pin 44 prevents the leg set 20 from disengaging from the self-locking box 28. The relationship of the lock pin 44 and the leg set 20 is best seen in the section view of FIG. 5.

The adjustable riser-ramp assembly 1, in the illustrated embodiment, is secured to the vehicle repair rack 2 on the work surface 3 by an adjustable retaining device 60. The adjustable retaining device 60 includes a pivot bar 62 attached to a spacer bar 64, which spacer bar 64 is attached to a clamp 66. The preferred embodiment includes two clamps 66 maintained in a spaced relationship by the spacer bar 64. The clamp 66 engage the work surface 3 of the rack 2 with the pivot bar 62 traversing the work surface. The leg traverse tube 24 of the platform 4 is slidingly engaged to the pivot bar 62. The operator may slide the assembly 1 along the pivot bar 62 to align the assembly with a vehicle wheel. The adjustable retaining device 60 can also be moved along a longitudinal axis of the work surface 3 also to align with the vehicle tires. As an operator selectively moves the platform body 6 from one position to another position, the leg traverse tube 24 pivots about the pivot bar 62.

In operation, a method for using the adjustable riser-ramp assembly 1 to support a vehicle above a work surface 3, an operator places an adjustable rise-ramp assembly 1 on the work surface 3. Each assembly includes a platform 4, a ramp 40 and an adjustable retaining device 60. The operator positions each assembly 1 to align with the vehicle and attaches the assembly to the work surface by tightening the clamps 66. If the platform 4 is not on the pivot bar 62 when the mounting slide 60 is attached to the work surface 3, the operator mounts the platform 4 to the mounting slide 60 and attaches the ramp 40 to each platform body 6. The operator may also adjust the wheel stop 32 on the front 5 of the platform 4. The operator may also add additional adjustable riser-ramp assemblies 1 as shown in FIG. 1. Depending upon the operation the operator needs to perform, the operator will lift the platform 4 of each assembly 1 to a high stage and the legs sets 20 of each platform 4 will self-lock in a vertical position. In some setups, the operator may move a ramp 40 from the rear 9 of the platform body 6 to the front 5 and in some setups the operator may attach an additional ramp 40 to each platform body 6.

Thus, it should be apparent that there has been provided in accordance with the present invention an apparatus for supporting a vehicle above a work surface with an adjustable riser-ramp assembly that includes a platform, at least one ramp and an adjustable retaining device and providing a variable height stage for such apparatus that fully satisfies the aims and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An adjustable riser ramp assembly for supporting a vehicle above a work surface, said assembly comprising:

a platform having a pair of adjustable leg sets with each leg set being self-locking and said platform is further provided with a guide slot for each leg set and with each leg set provided with a guide pin adapted to engage the guide slot as the leg set is selectively moved from one position to another position, a ramp attached to the platform with the ramp being provided with a pair of multi-level slide locks with each said slide lock including a slide plate having an angled lock slot with a front surface and a back surface, with said angled lock slot adapted to engage an angled key stock member fixed to the platform as the ramp is selectively moved from one position to another position, and an adjustable retaining device engaging the platform and having a means for connecting the assembly to the work surface.

2. The assembly of claim 1 wherein one position is a low stage and each leg set is foldable under the platform and the other position is a high stage with each leg set self-locking under the platform and in a vertical aspect with respect to the platform.

3. The assembly of claim 1 wherein the ramp is removably attached to the platform.

4. The assembly of claim 1 including an adjustable wheel stop attached to the platform.

5. The assembly of claim 1 including an additional ramp removably attached to the platform 180° from the other ramp.

6. A method for using an adjustable riser-ramp assembly for supporting a vehicle above a work surface, with said assembly including a platform having a pair of adjustable self-locking leg sets, a ramp removably attached to the platform by a pair of multi-level slide locks engagable with a key stock member mounted on the platform and an adjustable retaining device, said method including:

placing the adjustable riser-ramp assembly on a work surface, positioning the riser-ramp assembly to align with the vehicle, securing each assembly to the work surface by clamping the adjustable retaining device to the work surface, attaching the ramp to the platform, adjusting a wheel stop on the platform, lifting each platform to a high stage where the leg sets will self-lock in a vertical position, and selectively moving the vehicle on and off the adjustable riser-ramp assembly.

7. The method of claim 6 including the step of placing additional adjustable riser-ramp assemblies on the work surface.

8. The method of claim 7 including the step of moving a ramp from its initial attachment position on the platform to another attachment position on the platform opposite the initial position.

9. The method of claim 7 including the step of attaching an additional ramp to a platform.

* * * * *